US006216767B1

(12) United States Patent
McMellon

(10) Patent No.: US 6,216,767 B1
(45) Date of Patent: Apr. 17, 2001

(54) MOLD HANDLING APPARATUS

(75) Inventor: Bruce Alton McMellon, Birmingham, AL (US)

(73) Assignee: Vulcan Engineering Company, Inc., Helena, AL (US)

( * ) Notice: Subject to any disclaimer, the term of this patent is extended or adjusted under 35 U.S.C. 154(b) by 0 days.

(21) Appl. No.: 09/479,726

(22) Filed: Jan. 7, 2000

(51) Int. Cl.[7] ..... B22D 33/00
(52) U.S. Cl. ..... 164/324; 164/167
(58) Field of Search ..... 164/322, 323, 164/324, 325, 326, 327, 328, 329, 330, 331, 167

(56) References Cited

U.S. PATENT DOCUMENTS 4,054,172 * 10/1977 Hansberg ..... 164/168
4,299,269 * 11/1981 Friesen et al. ..... 164/324
4,736,787 * 4/1988 McMellon ..... 164/154

* cited by examiner

*Primary Examiner*—Harold Pyon
*Assistant Examiner*—Len Tran
(74) *Attorney, Agent, or Firm*—Roibert J. Veal; Christopher A. Holland; Burr & Forman LLP

(57) ABSTRACT

A pouring conveyor in the form of a continuous loop receives sand molds on pallets or other mold carriers and conveys the empty molds to a pouring station wherein molten material is deposited therein to form castings. Each mold is provided with a supportive weight and jacket before pouring. Thereafter, the molds with the weight and jacket surrounding them, pass through a primary cooling line, at the end of which molds and weight and jacket are separated in a jacket transfer station. The weighted jacket is removed and transferred to an on-coming freshly made mold while the castings pass through a secondary cooling zone for further cooling and subsequently discharged said conveyor. The process allows for a substantially smaller number of weight jacket combinations and floor space than previously known molding processes.

2 Claims, 3 Drawing Sheets

MOLD HANDLING APPARATUS

BACKGROUND OF THE INVENTION

The present invention relates generally to conveyor systems and has particular reference to an intermittent or step-by-step conveyor system which is designed primarily for handling sand molds in a foundry casting operation of the like and wherein the unpoured molds are conducted on individual pallets through various mold-handling and treating stations to a mold discharge station where the poured and partially cooled and solidified mold-encased castings are ejected from the system for shake-out purposes. It is conventional for foundries to have automated conveyor systems which intermittently advance sand molds from a mold making station, through a cooling section of the conveyor, to a jacket and removal station, and through other operations stations until the metal casting is finally removed from the disintegrated sand mold. These systems involve the problem of removing the jacket and weight from each partly cooled mold and its solidified casting, and transporting to another portion of the conveyor and subsequently applying the jacket to a freshly formed green sand mold approaching the pouring station. A mold-handling system of the general character under consideration usually requires jacket-setting because in making a casting, when molten metal is poured into a sand mold to produce the casting, the outward pressure on the mold walls may cause mold rupture so that what is commonly referred to as a "run-out" of the metal takes place. It is common practice to surround each mold with an encompassing metal jacket which will withstand such outward pressure on the mold walls, the jacket being placed upon the cold mold prior to the pouring operation and such pouring operation taking place with the jacket in position on or around the mold. Subsequently and after a predetermined cooling period has elapsed so that undue outward pressure on the mold walls is alleviated, the jacket is removed and the mold-encased casting is then ready for the usual shake-out operation for effecting removal of the mold from the formed casting.

The use of curvilinear or serpentine type mold-handling system has been said to be possessed of certain limitations, principal among which is the necessity for utilizing a relatively complicated jacket transfer mechanism which is capable of transferring a jacket from a hot poured and palletized mold in the second longitudinal path of pallet movement to a cold unpoured and palletized mold in the first longitudinal path of pallet movement. Since the two molds between which the jacket transfer is to be effected are laterally displaced from each other and occupy positions in different laterally spaced apart longitudinal paths of pallet movements, it is necessary for the jacket transfer mechanism to employ a superstructure which bridges or overlies both paths and embodies overhead gripping facilities. Such jacket transfer operations are carried out by first vertically aligning the gripping facilities of the system with the hot jacketed and poured mold in the second path and then lowering such gripping facilities and causing them to engage the jacket on such mold, after which raising of the facilities will cause the gripped jacket to be picked up from the hot mold and raised until the jacket clears the subjacent mold. Thereafter, such gripping facilities with the jacket held thereby are shifted laterally so as to become aligned with the cold unjacketed mold in the first longitudinal path, after which lowering thereof will place the jacket on the cold mold, whereupon release of the gripping facilities will leave the jacket operatively positioned on the cold mold. The, thus, released gripping facilities are again elevated into the confines of the superstructure and indexing of the conveyor system is resumed, thus shifting the hot mold, now relieved of its jacket, longitudinally and rearwardly out of the jacket removal station and shifting the cold mold with the newly applied jacket thereon longitudinally and forwardly out of the jacket-applying station. In known prior art systems, time is lost during performance of the actual jacket transfer operations which includes such steps as opening and closing the jaws of the gripper facilities, as well as shifting such facilities from one path to the other and back again. These problems have been repeatedly addressed in the prior art. Freisen, in U.S. Pat. No. 4,299,269, taught a chain of individually suspended mold-carrying gondolas which is intermittently moved around a closed curvilinear post-suspended track, each gondola being capable of carrying one or more sand molds on pallets, (also known as mold boards). In a preferred form of the invention, each gondola carries two molds, each on a separate pallet positioned end to end across the line of travel of the gondolas, the pallets resting on the gondola floors which are provided with slide members permitting the pallets to be movably positioned as to outer and inner locations.

U.S. Pat. No. 4,422,495, issued to Van Nette, III et al taught a system in which mold carrying cars are moved along a closed loop which projects vertically for minimizing required floor space. The empty cars are vertically raised by a first elevator located at one end of the loop for positioning an empty car adjacent a mold-handling conveyor, whereupon one or more molds are pushed onto the empty car, from which it is transferred into a pre-pour mold storage. From this storage the mold-bearing car is moved forwardly along a guide rail onto a second elevator which lifts the car upwardly adjacent an elevated pouring deck. As the mold is elevated, a jacket and weight are automatically deposited thereon, and the mold is poured while the car rests on the second elevator. The mold-bearing car is then moved forwardly along a guide rail through a jacket-and-weight transfer station. When reaching the end of this station, the jacket and weight are automatically removed and recycled back for positioning on another mold arriving on the second elevator. After the jacket and weight are removed, the mold-bearing car is moved forwardly along the guide rail through a cooling region, which region may be of two levels with the individual cars being positioned on either level by means of elevators. Upon reaching the end of the cooling section, the mold car is transferred onto a third elevator which, when in its raised position, is tiltable so that the mold is dumped from the car, with the car being cleaned by a suitable brush. After dumping, the third elevator is lowered and the mold car transferred onto a lowermost return guide rail which, through a walking beam arrangement, transfers the empty cars back to the first elevator. The return guide rail, together with at least a portion of the rail defining the pre-pour mold storage, extends in parallel relationship beneath the elevated pouring deck so that a maximum number of cars can be recirculated along the path while minimizing the required floor space within the foundry.

U.S. Pat. No. 3,955,613 issued to Lund May 11, 1976 taught using longitudinal and transverse paths which also index alternately, establishes an intersection of a longitudinal and a transverse path such that following a transverse index the intersection will be occupied by a poured mold with jacket and following a longitudinal index the intersection will be occupied by an unpoured mold requiring a jacket.

None of the prior art available for casting in green sand systems solves the problems of speed and flexibility presented above; therefore, a need exists for a novel sand casting system an apparatus for metal jacketed casting.

SUMMARY OF THE INVENTION

It is an object of the present invention to provide a minimal footprint foundry casting conveyor which provides highly efficient use of the weight and jacket technology to permit concurrent pouring, cooling, and discharge on a single conveyor.

Another object of the invention is the simplification of handling equipment necessary to transfer weight and jacket members between casting lines.

Other objects and advantages of the improved system will become apparent from the reading of the specification and review of the drawings.

Although the statements in the prior art belittle the use of a continuous system in a closed loop, the present invention overcomes the problems of such a system by utilizing the inherent symmetry of such a system to its advantage. The present system is a closed curvilinear system of pallets or mold boards which advance proximal a pouring station located at one end of the system. As is well known, jackets and weights are used and must be placed about the sand molds prior to pouring and removed prior to shake out. The present invention relies on a cross shuttle arrangement positioned transverse to the linear portion of the conveyor and reciprocal perpendicular to the direction of movement of the conveyor. The shuttle uses a single actuator to coordinate the movement of two distinct units one of which places and removes the weights from the mold and the other which displaces the molds laterally to iteratively remove molds and castings and to permit another unweighted casting to traverse the conveyor for additional cooling.

BRIEF DESCRIPTION OF THE DRAWINGS

Apparatus embodying features of my invention are depicted in the appended drawings which form a portion of this disclosure and wherein.

DESCRIPTION OF THE PREFERRED EMBODIMENT

Figure 1:
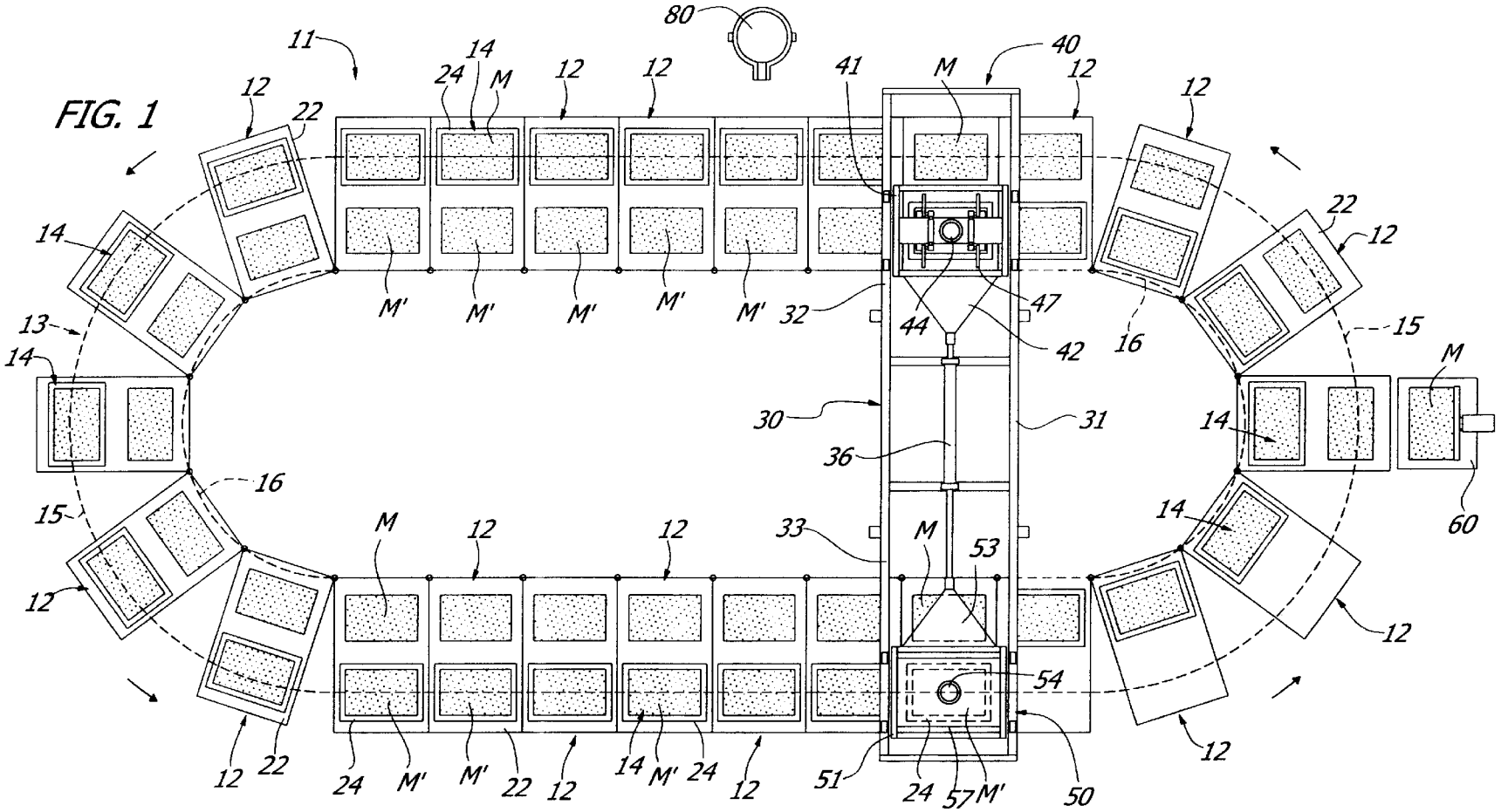
FIG. 1 is a plan view of a conveyor in accordance with the invention.

Referring to the drawings for a clearer understanding of the invention, it may be seen in FIG. 1 that my invention comprises an endless train conveyor 11, having a plurality of separate, pivotally connected cars 12, or trolleys as they are sometimes called. In the preferred embodiment, cars 12 are pivotally connected at adjacent corners in much the same manner as the gondolas in my U.S. Pat. No. 4,736,787. However, it is to be understood that the invention is not so limited and the cars may be pivotally connected along their center line if so desired. It is however necessary that the pivotal connection be such as to avoid introduction of any substantial play in the train as the cars are required to iteratively stop at relatively precise positions. The cars are supported on a set of wheels or rollers 17 on a curvilinear track 13 having support rails 15 and 16. The cars arc maintained in lateral alignment on the track 13 by a set of rail followers 18 and 19 affixed to selected wheels 17 or by a suitable centering mechanism such that the train is properly positioned on the track. The drive mechanism for the train 11 may be any suitable mechanism including a hydraulically driven carriage carrying a gripper to engage each car 12 sequentially to move the train 11 one car length or other suitable multiple such that the train is incrementally indexed a fixed distance. Alternative drives such as a chain drive, pinion gear drive, geneva gear drive, with appropriate stops to insure that the train stops with the cars in the proper location during each iteration are well known and will not be discussed in detail.

Each car 11 includes a frame 21 supported on the wheels 17 on which a substantially flat bottom board 22 is mounted. The board 22 is sufficiently wide to accommodate two sand molds M and M' which are made by any conventional process in a sand molding machine. The molds M and M' are delivered to the mold board by a conventional pusher from the molding machine such that the molds are arranged in side by side relationship across the track 13. As noted above the molds must be jacketed and weighted with a weight and jacket combination 14 before molten metal can be poured into their internal cavities to form the cast object. In FIG. 1 it can be seen that the molds supported on the train of cars form an inner course and an outer course with the molds being loaded onto the conveyor on the outer course. The present invention is designed to remove a weight and jacket from a mold on the inner course which has undergone sufficient cooling and transfer it to a mold on the outer course that is about to be filled with molten metal, while simultaneously moving a jacketed and weighted mold which has been filled with molten metal from the outer course to the inner course and removing a casting with its mold from the inner course to a shakeout table. Thus, operations on four molds are performed in each iterative stop of the conveyor and a fifth mold is delivered to the conveyor outer course.

Figure 2:
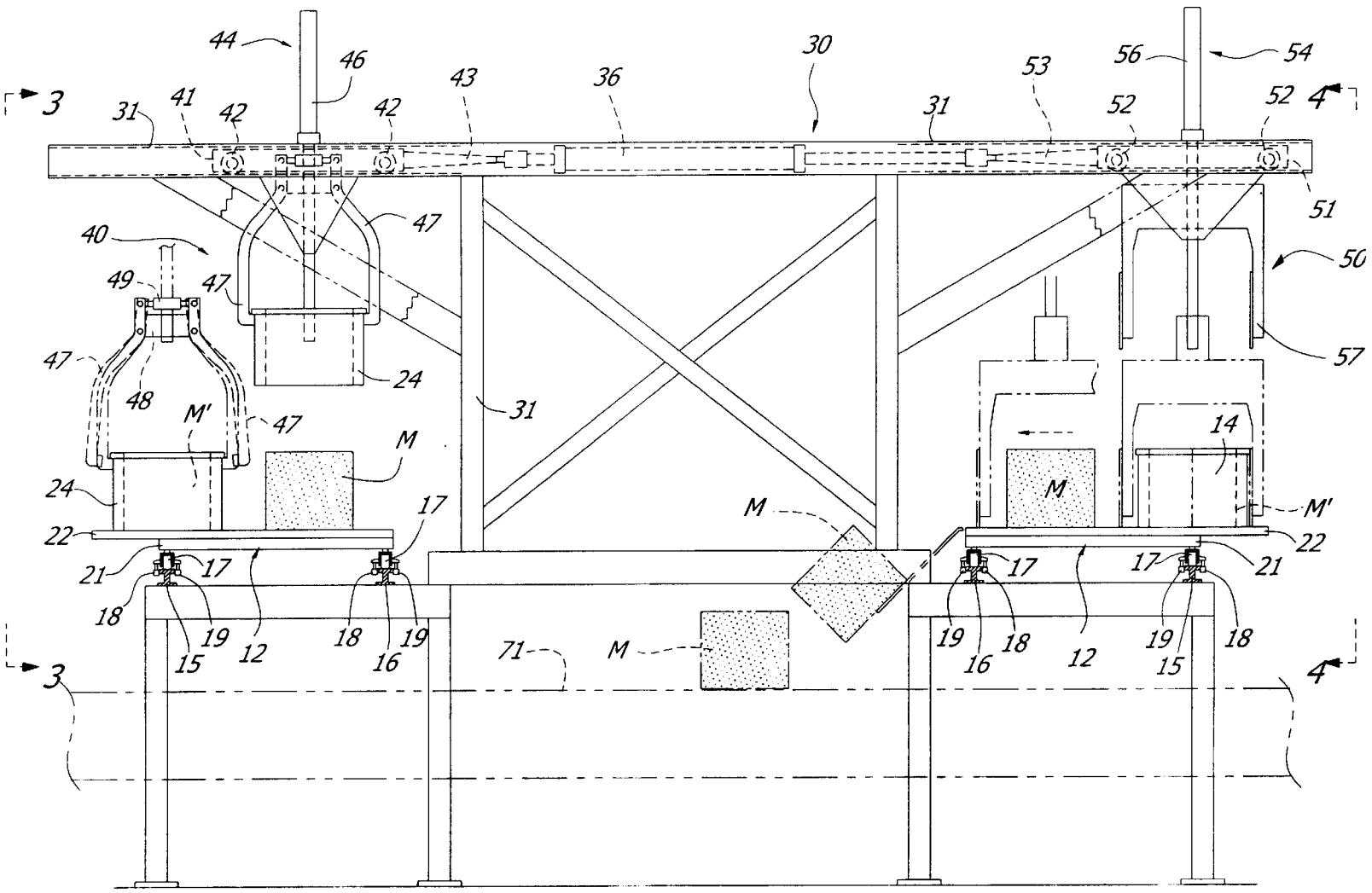
FIG. 2 is a side elevational view taken along a section adjacent the shuttle mechanism.
Figure 4:
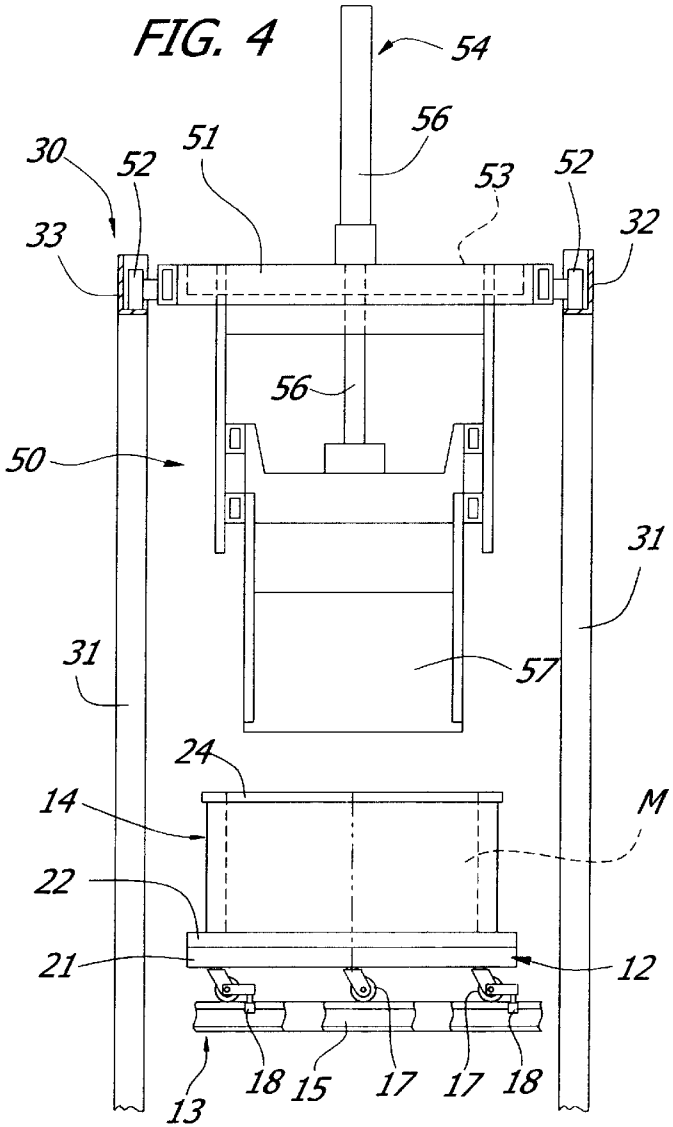
FIG. 4 is an elevational view taken along line 4—4 of FIG. 2.

To accomplish the operations on the four molds I use a cross conveyor 30 as shown in FIG. 2. Cross conveyor 30 comprises an upstanding frame 31 supporting a set of cross rails 32 and 33 extending over track 11 within the linear portion of the track. Disposed on cross rails 32 for movement transverse to the track 11 is a weight and jacket setting (WJS) assembly 40. Disposed on cross rails 33 for movement transverse to track 12 is a mold push off (MPO) assembly 50. In the preferred embodiment a double ended linear actuator or cylinder 36 is mounted to the frame and connected to assembly 40 and 50 for concomitant movement thereof. While I have illustrated a cylinder as the linear actuator of choice, it should be understood that a worm gear, chain drive, stepper motor, or other suitable drive which can shuttle the assemblies between two predetermined positions will be acceptable as long as the assemblies can be accurately positioned at each position. That is to say, the actuator is connected such that weight jacket setting assembly 40 will move from above the inside course beneath cross rails 32 to above the outside course while push off assembly 50 moves from the outside course to the inside course beneath rails 33.

WJS assembly 40 includes a shuttle carriage 41 mounted on a set of rollers or wheels 42 which are engaged on cross rails 32. Shuttle carriage 41 is connected to cylinder 36 by a transition 43 and positioned such that iterative actuation of the cylinder 36 moves the carriage between two positions, one located over the outer course of sand molds and the other over the inner course of molds. Carriage 41 supports a mast assembly 44 which includes a vertically oriented linear acuator 46 and associated guides. The actuator 46 has connected at a lower end there of a gripper 47 having a pair of arms 47*a* and 47*b* pivotally mounted to a frame 48 and interconnected near their upper ends by a gripper actuator 49.

MPO 50 includes a shuttle carriage 51 mounted on a set of roller or wheels 52 which are engaged on cross rails 33. Shuttle carriage 51 is connected to cylinder 36 by a transition 43 and positioned such that iterative actuation of the cylinder 36 moves the carriage between two positions, one located over the inner course of sand molds and one located over the outer course of sand molds. Carriage 51 will be over the inner course when carriage 41 is over the outer course and vice versa. Carriage 51 supports a mast assembly which includes a vertically oriented linear actuator 56 and associated guides. Connected to the lower end of actuator 56 is a weldment 57 which fits over the outside of a weight and jacket combination 14.

Figure 3:
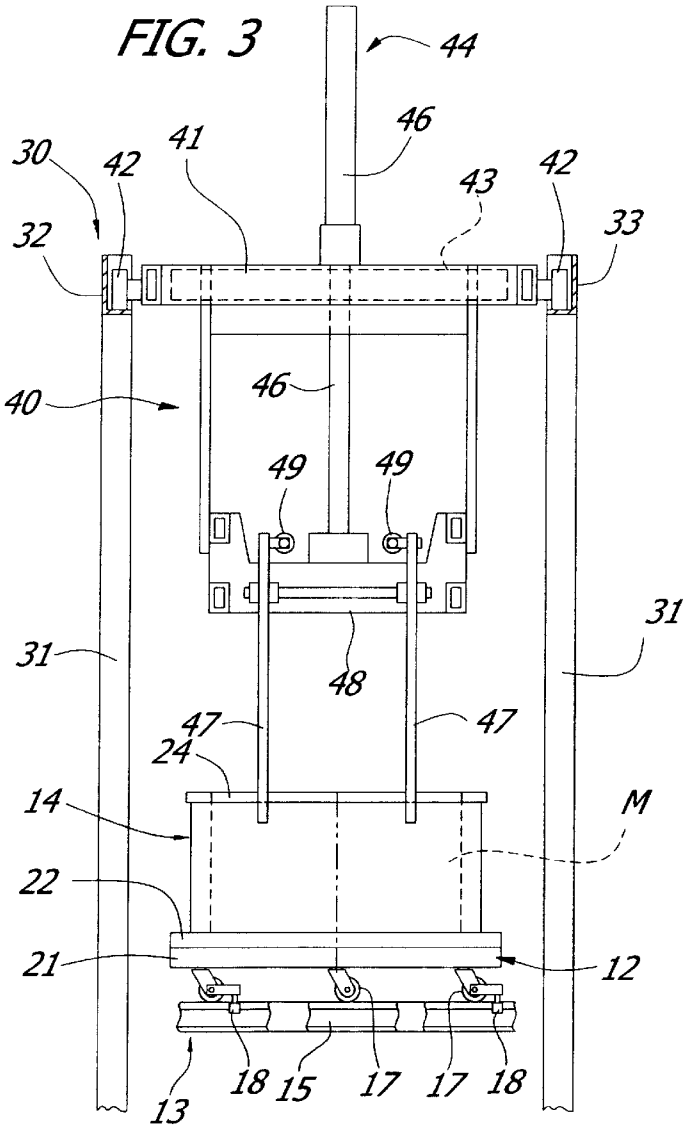
FIG. 3 is an elevational view taken along line 3—3 of FIG. 2.

Referring to FIG. 3, it may be seen that each carriage has space thereon for two sand molds, which are introduced at molding machine 60 by a transfer mechanism known in the art, such as that disclosed by Freisen in U.S. Pat. No. 4,299,269. The mold loading station and equipment may be conveniently located in accordance with the time requirements for the casting line. That is to say, dependent upon the metal being cast and the size of the casting the cooling times will vary, accordingly, the molds may need to be available for pouring so as to maximize the cooling time while the molds are on the conveyor. Accordingly, with reference to FIG. 3, assuming that the conveying line is moving in a counter clockwise direction, MPO 51 would push a weighted and jacketed mold containing a poured casting from the outside course to the inside course, simultaneously urging an unjacketed sand mold and associated casting off the conveyor onto a shakeout table 71. The outside position on the carriage is thus vacant and ready to receive a fresh sand mold, which could be placed at any dwell position of the conveyor between MPO 50 and WJS 40, such as adjacent molding machine 60 in FIG. 3. As the conveyor indexes one carriage length at a time or a multiple of one carriage length at a time, each carriage bearing a fresh sand mold on the outer side and a jacketed and weighted sand mold including a poured casting on the inner side will stop beneath WJS 40. Gripper 47 will be lowered by actuator 46 to engage the jacket and weight 14 and raised by actuator 46 to lift them from the mold on the inner course. Actuator 36 then moves carriage 41 to the outside course, whereupon actuator 46 lowers gripper 47 bearing jacket and weight 14 about the fresh sand mold. The gripper 47 disengages under the control of actuator 49 and actuator 46 raises the gripper. The jacketed and weighted mold is then advanced to the pouring station 80 at which molten metal is poured into the mold cavity.

As noted above, the action of WJS 40 is concomitant with MPO 50 inasmuch as both units are preferably moved laterally by the same actuator 36. Thus, when actuator 46 lifts weight and jacket 14 from the inner sand mold, actuator 56 lowers the weldment 57 to engage the weight and jacket on the outer course of the subjacent carriage. As actuator 36 urges WJS 40 from inner course to outer course with actuator 46 retracted, MPO 50 is urged from outer course to inner course with actuator 56 extended such that the engaged mold and associated jacket and weight are slid from the outer course to the inner course, thereby forcing the unjacketed inner mold from the carriage onto an ejection slide which directs the mold and casting to a shakeout table or other suitable conveyor for separation of the sand from the casting. As actuator 46 sets jacket and weight 14 on the fresh mold and retracts actuator 56 retracts, whereupon actuator 36 can move WJS 40 and MPO 50 laterally.

It is to be understood that the casting line is an automated system with a plurality of control sensors. For example, sensors such as proximity switches, limit switches, or photoelectric sensors can be positioned to indicate when each carriage is properly positioned beneath the WJS or MPO, when each vertical actuator 46 or 56 is in its retracted or extended position, when gripper 47 is open or closed, when the mold loading apparatus has inserted a fresh mold, and when the associated pouring station has completed its pouring operation. Each sensor output is utilized in a control circuit which may include a ladder logic circuit, a programmable logic circuit, a central processing unit based computer such as a PC, or any other conventional electrical control circuit which can be configured to receive input from the sensors and control the actuation of the transfer station as well as the conveyor.

What I claim is:

1. Apparatus for handling sand molds on a closed loop conveyor wherein said conveyor includes a plurality of carriages forming an endless loop and interconnected for concomitant indexed motion in increments based on the length of one of said plurality of carriages about said loop comprising, in combination:

a. a weight and jacket shifting assembly mounted on one side of said closed loop conveyor for lateral movement relative to said closed loop conveyor;

b. a mold push off assembly mounted on an opposite side of said closed loop conveyor in opposition to said weight and jacket shifting assembly for concomitant lateral movement relative to said closed loop conveyor; and, c. means for interconnecting between and concomitantly urging said weight and jacket assembly and said mold push off assembly laterally relative to said closed loop conveyor.

2. Apparatus as defined in claim 1 wherein said means for concomitantly urging comprises a linear actuator interconnected between said weight and jacket assembly and said mold push off assembly to move each of said assemblies in the same direction at the same time for the same distance.

* * * * *